US005657982A

United States Patent [19]

Holmes et al.

[11] Patent Number: 5,657,982

[45] Date of Patent: Aug. 19, 1997

[54] MAIL SORTING DEVICE

[75] Inventors: Lawrence B. Holmes, Hunt Valley, Md.; Giuseppe Puzzanghera, Genova, Italy; Renato Gritti, Rapallo, Italy; Guido De Leo; Vincenzo Priolo, both of Genova, Italy

[73] Assignee: Finmeccanica, S.P.A., Roma, Italy

[21] Appl. No.: 514,173

[22] Filed: Aug. 11, 1995

[30] Foreign Application Priority Data

Aug. 12, 1994 [IT] Italy ..... TO94A0662

[51] Int. Cl.[6] ..... B65H 1/02

[52] U.S. Cl. ..... 271/149; 271/2; 271/150; 414/798.9

[58] Field of Search ..... 414/798.9; 198/465.1, 198/717, 803.02; 271/2, 147, 149, 158, 150

[56] References Cited

U.S. PATENT DOCUMENTS

| | | | |
|---|---|---|---|
| 2,161,124 | 6/1939 | Babicz | 271/149 |
| 4,867,430 | 9/1989 | Volat | 271/150 |
| 4,891,088 | 1/1990 | Svyatsky | 271/150 |
| 5,044,877 | 9/1991 | Constant et al. | 198/717 |
| 5,379,992 | 1/1995 | Holmes et al. | 271/2 |
| 5,413,323 | 5/1995 | Imbert et al. | 271/149 |

FOREIGN PATENT DOCUMENTS

| | | |
|---|---|---|
| 111432 | 6/1984 | European Pat. Off. . |
| 295170 | 12/1988 | European Pat. Off. . |
| 582869 | 2/1994 | European Pat. Off. . |
| 2382387 | 9/1978 | France . |

*Primary Examiner*—David A. Bucci
*Assistant Examiner*—Douglas Hess
*Attorney, Agent, or Firm*—Lowe, Price, LeBlanc & Becker

[57] ABSTRACT

A mail sorting device wherein an inclined supporting surface cooperates with a guide device presenting a number of push surfaces spaced along the supporting surface and movable from a back stop towards a front stop adjacent to the upper end edge of the supporting surface. The supporting surface supports a number of flat rectangular mail items grouped into stacks interposed between adjacent push surfaces; and the sorting device presents a grip-and-carry device facing the end edge of the supporting surface, and in turn presenting a gripping head movable to and from the supporting surface to withdraw one mail item at a time from the stack and feed it to a conveyor device. The guide device provides for feeding the push surfaces back from the front stop to the back stop.

16 Claims, 7 Drawing Sheets

MAIL SORTING DEVICE

BACKGROUND OF THE INVENTION

The present invention relates to a device for sorting flat, rectangular items, in particular mail items.

Mail sorting machines for substantially flat, rectangular items (such as letters, envelopes, folded magazines and newspapers, etc.) are supplied by upstream stages in the process, where the items are generally arranged in disorderly, substantially mixed stacks.

It is therefore difficult to automatically extract (sort) the items from the stack and load them on to the input device of a follow-up processing machine (e.g. a conveyor belt).

For automatically sorting the items, sorting devices have been devised for extracting flat mail items from a stack and loading them on to a conveyor device connected to a mail processing machine.

European Patent Application EP-A-582.869 by FINMECCANICA S.p.A., for example, relates to a sorting device for flat, rectangular items, whereby a supporting surface inclined to the horizontal supports a stack of mail items pushed by a slide towards a stop device located along the top front edge of the supporting surface.

The sorting device comprises a gripping head movable three-dimensionally in space, and which provides for releasably engaging the front surface of an item contacting the stop device, withdrawing the item from the stack, and releasing it on to a conveyor device, e.g. a conveyor belt.

In view of the considerable size and weight of the stack processed by the above sorting device, manual loading of the stack is awkward and requires a good deal of effort, and difficulty is encountered in automatically moving it along the inclined supporting surface.

SUMMARY OF THE INVENTION

It is an object of the present invention to improve the sorting device described above.

According to the present invention, there is provided a mail sorting device comprising:

- a supporting surface for supporting a number of flat mail items,
- said supporting surface presenting an end edge connected to stop means;
- a grip-and-carry device facing said end edge and presenting at least one gripping head movable to and from said supporting surface,
- said gripping head withdrawing a mail item from said supporting surface, and feeding it to a conveyor device; and
- conveyor means for feeding said mail items towards said stop means;
- characterized in that said conveyor means comprise a number of push surfaces spaced along said supporting surface and moved towards said stop means by drive means;
- said mail items being grouped into stacks (STK) interposed between adjacent said push surfaces.

BRIEF DESCRIPTION OF THE DRAWINGS

A preferred, non-limiting embodiment of the present invention will be described by way of example with reference to the accompanying drawings, in which.

DETAILED DESCRIPTION OF THE INVENTION

Figure 1:
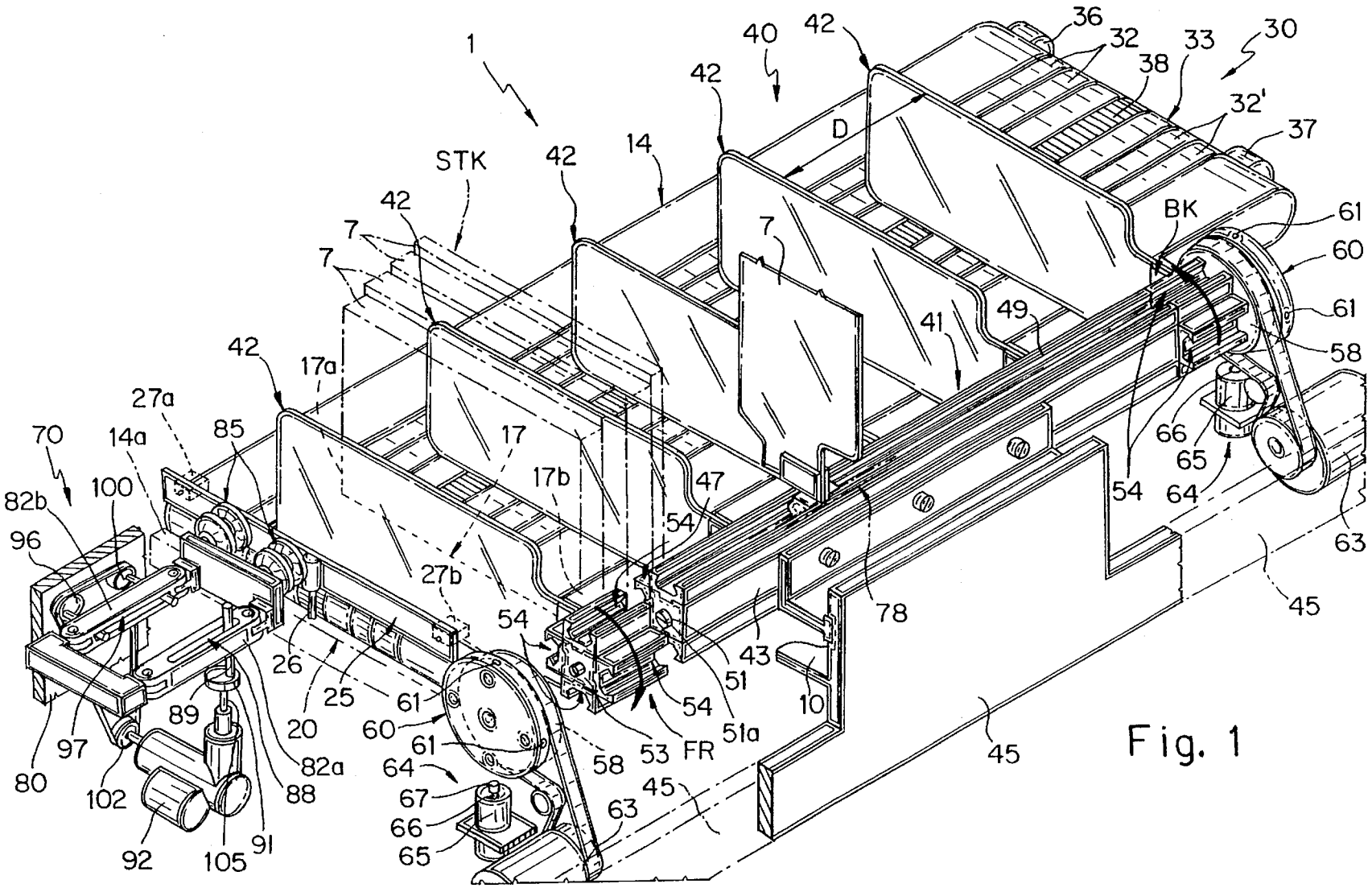
FIG. 1 shows a simplified view in perspective of a mail sorting device in accordance with the teachings of the present invention.

Number 1 in FIG. 1 indicates a sorting device for rectangular items 7, in particular flat, rectangular mail items (such as letters, envelopes, polythene wrapped or banded magazines and newspapers, packets, etc.).

Mail items 7 conveniently present a length of 200–380 millimeters, a width of 100–280 millimeters, a maximum thickness of 25 millimeters, and a maximum weight of 2 kilograms.

Device 1 is mounted on a bed (not shown) comprising a flat, horizontal base 10 (shown schematically in FIG. 1) supporting a rectangular surface 14 inclined roughly 10° in relation to base 10.

Figure 2:
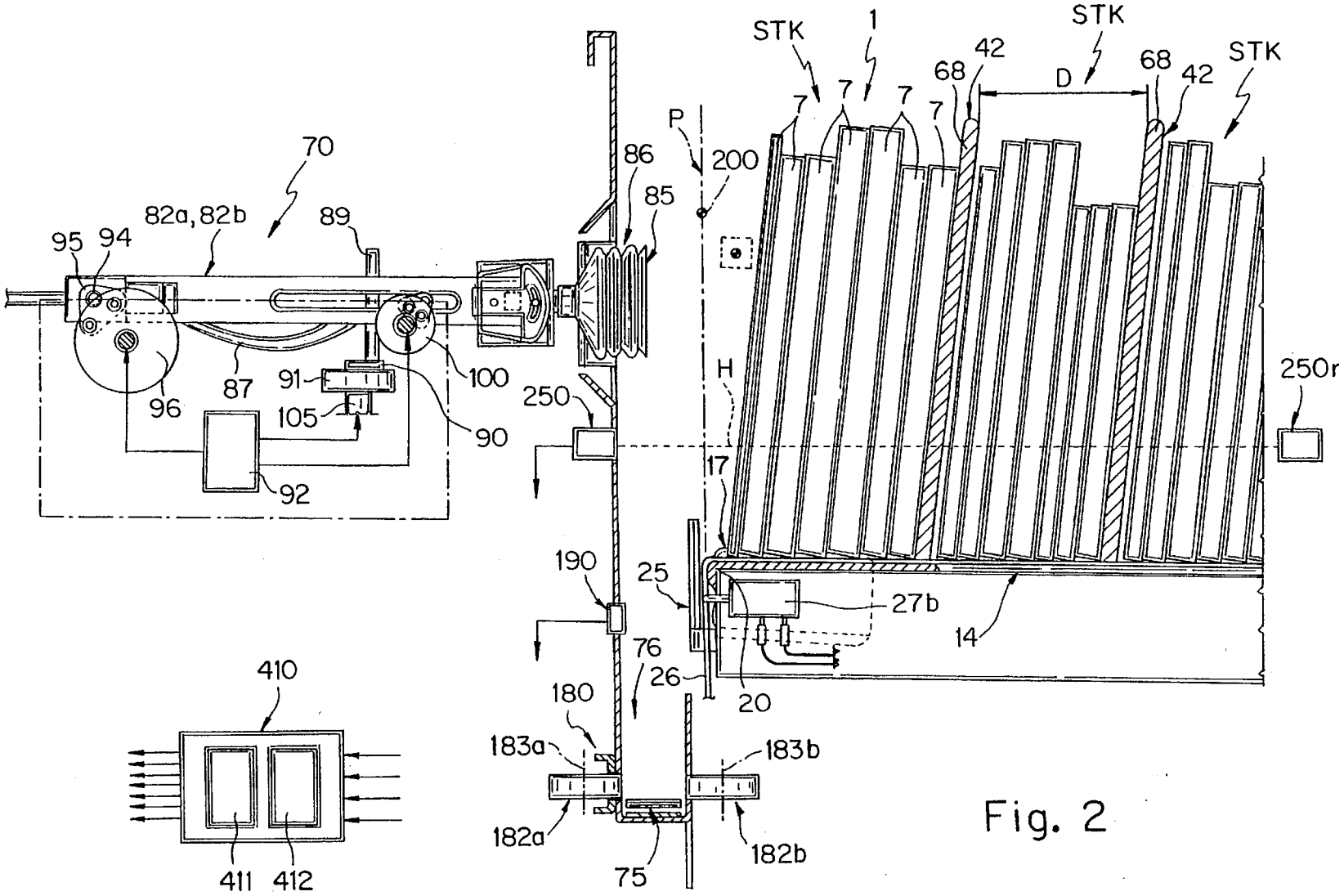
FIG. 2 shows a partial longitudinal section of the FIG. 1 device.

Surface 14 supports mail items 7, each of which is arranged with its straight bottom edge 17 (FIGS. 1 and 2) contacting surface 14. Surface 14 presents a straight front end edge 20, in front of which is positioned a stop element 25 comprising an elongated rectangular plate perpendicular to surface 14, and presenting a central portion hinged to a pin 26 defining an axis perpendicular to edge 20. Plate 25 presents an elastic device (not shown) for enabling it to rotate about pin 26.

Plate 25 is connected to a first and second sensor (e.g. microswitch) 27*a*, 27*b* located at opposite ends of edge 20, and which are activated by opposite portions of plate 25 to determine the impact of left or right portions 17*a*, 17*b* of edge 17 on plate 25; and plate 25 is rotatable angularly about axis 26 between a stable idle position wherein it is parallel to edge 20, and two activating positions (not shown) wherein it activates the first or second sensor 27*a*, 27*b*.

Surface 14 also presents a conveyor assembly 30 comprising two pairs of belts 32 and 32' extending parallel to the longer edges of surface 14, from end edge 20 to the opposite end edge 33, and presenting an upper straight portion coplanar with surface 14. Pairs of belts 32, 32' are parallel to each other, are moved independently in relation to surface 14 and at adjustable speed towards edge 20 by respective (reversible) actuators 36, 37, and provide for engaging respective left and right portions 17*a*, 17*b* of bottom edge 17 of items 7 as described later on.

Figure 5:
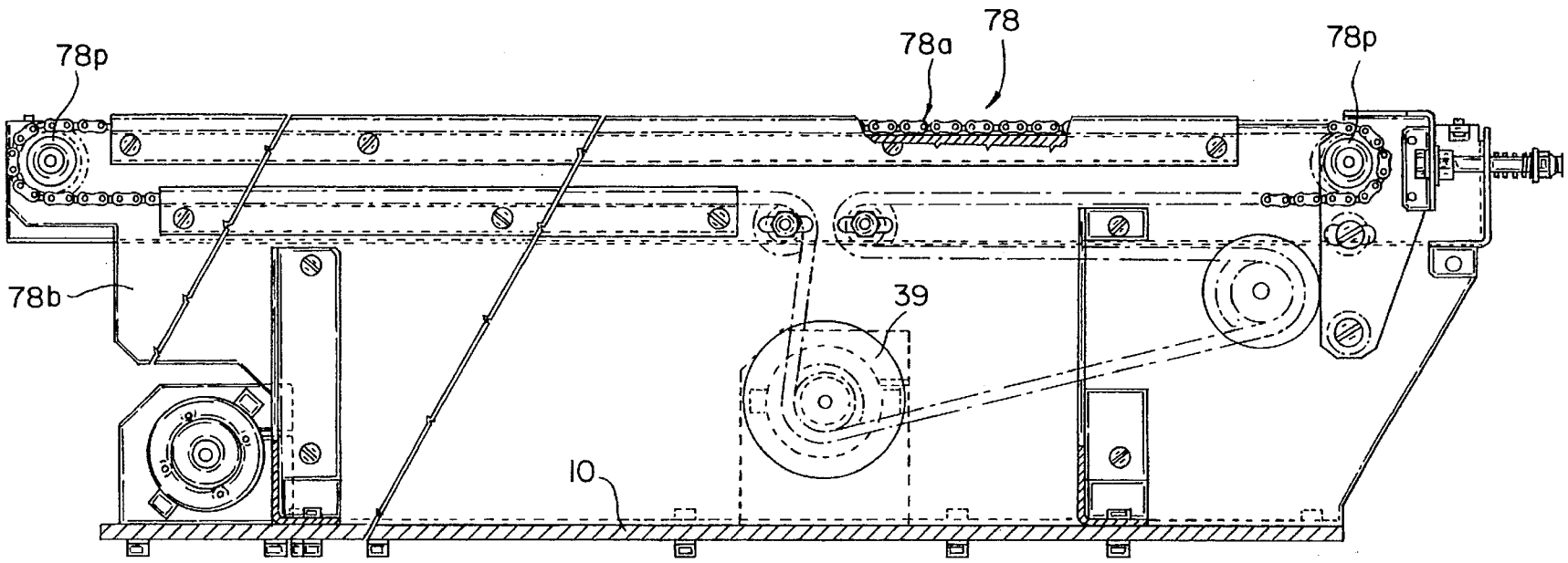
FIG. 5 shows a section of the FIG. 3 detail along line V—V in FIG. 3.

Surface 14 also presents a central toothed belt 38 between and parallel to pairs of belts 32, 32', substantially coplanar to surface 14, and driven by an actuator, e.g.d.c. motor, 39 (FIG. 5).

Sorting device 1 also presents a mail feeding device 40 comprising a guide device 41 extending along one of the longer straight edges of surface 14 and supporting a number of (e.g. ten) push surfaces 42 parallel to one another, substantially perpendicular to surface 14, and substantially equally spaced along surface 14 by distance D (roughly 70 millimeters).

With a bottom portion engaging toothed belt 38, push surfaces 42 travel along surface 14 from a back stop BK of device 41, close to edge 33, to a front stop FR of device 41, close to edge 20.

On reaching front stop FR, each push surface 42 is released from surface 14 (as described later on) and is reversed back to back stop BK; and, on reaching back stop BK, each push surface 42 is moved towards surface 14 to engage toothed belt 38 (as described later on), and again travels towards front stop FR.

Figure 3:
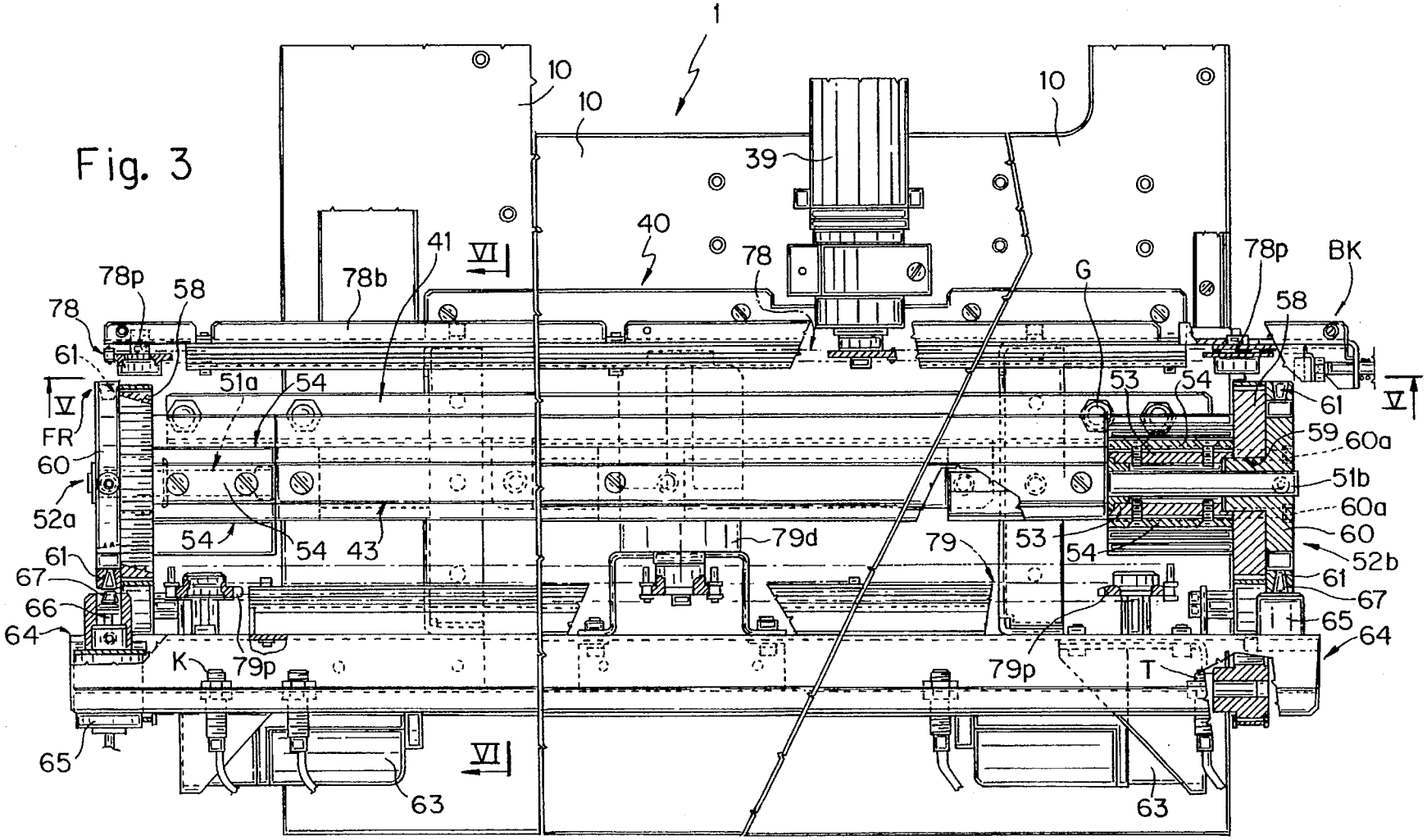
FIG. 3 shows a larger-scale top plan view of a first detail of the FIG. 1 device.

A detailed description of guide device 41 will now be given with special reference to FIGS. 1, 3 and 6.

Guide device 41 comprises a straight, square-section bar 43 extending parallel to one of the longer edges of surface 14, and fitted to the vertical wall 44*a* of a bracket 44 extending from a vertical side 45 of the bed (not shown).

More specifically, bar 43 presents a first rectangular face 43*a* fitted to bracket 44 by screws 46; a second face 43*b* opposite first face 43*a* and facing surface 14; a third face 43*c* facing base 10; and a fourth face 43*d* opposite third face 43*c* and facing upwards.

Second face 43*b* is fitted stably with a straight guide 47 comprising a rectangular metal section extending along the full length of bar 43 and presenting a longitudinal, substantially hexagonal-section groove 48.

Fourth face 43*d* is fitted stably with a straight guide 49 comprising a rectangular metal section extending along the full length of bar 43 and presenting a longitudinal, substantially hexagonal-section groove 50.

At each end, bar 43 presents an axial hole engaged by an end pin 51*a*, 51*b* projecting from bar 43 at front and rear stop FR, BK respectively.

Each end pin 51*a*, 51*b* supports a respective rotary assembly 52*a*, 52*b* located respectively at the front and rear stop FR, BK of guide device 41.

As rotary assemblies 52*a*, 52*b* are structurally identical, the parts composing or cooperating with them will be indicated, for the sake of simplicity, without the a or b in the following description.

Each rotary assembly 52*a*, 52*b* comprises a straight, square-section bar portion 53 of the same width as bar 43 and presenting a longitudinal through hole engaged in angularly movable manner by pin 51*a*, 51*b*.

Straight bar portion 53 presents four rectangular lateral surfaces fitted with respective straight guides 54, each comprising a metal section with the same cross section as sections 47, 49, and the same length as bar portion 53.

Each straight bar portion 53 presents a first end portion facing the free end of bar 43; and a second end portion stably connected to a toothed pulley 58 presenting a central hole 59 coaxial with and engaged by pin 51*a*, 51*b*.

Each rotary assembly 52*a*, 52*b* also comprises a disk body 60 coaxial with pin 51*a*, 51*b* and stably fitted to pulley 58 by screws 60*a* (FIG. 3) extending from disk body 60 to bar portion 53. Disk body 60 is larger in diameter than pulley 58, and presents a cylindrical lateral surface coaxial with pin 51*a*, 51*b* and in which are formed four truncated-cone-shaped dead holes 61 perpendicular to one another in relation to pin 51*a*, 51*b*.

Figure 6:
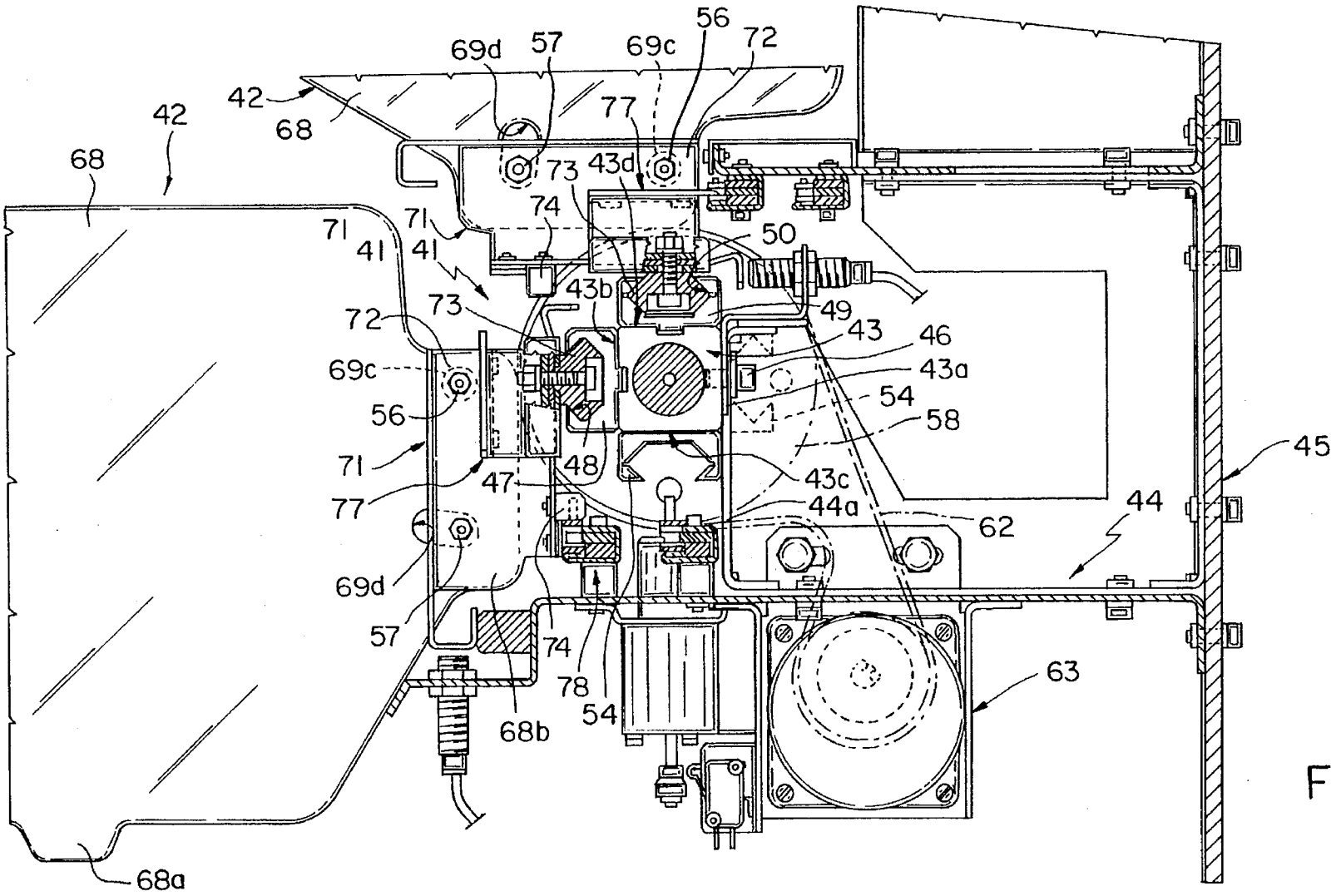
FIG. 6 shows a section of the FIG. 3 detail along line VI—VI in FIG. 3.

As shown particularly in FIG. 6, each toothed pulley 58 is fitted with a toothed belt 62 driven by an electronically controlled electric motor 63 fitted to bracket 44.

The power supplied by motor 63 is thus transmitted by belt 62 to toothed pulley 58 and hence to the whole of rotary assembly 52*a*, 52*b* which is movable angularly about pin 51*a*, 51*b*.

Each rotary assembly 52*a*, 52*b* cooperates with a locating assembly 64 (FIGS. 1, 3) for defining predetermined angular positions of assembly 52*a*, 52*b* in relation to pin 51*a*, 51*b*.

Figure 4:
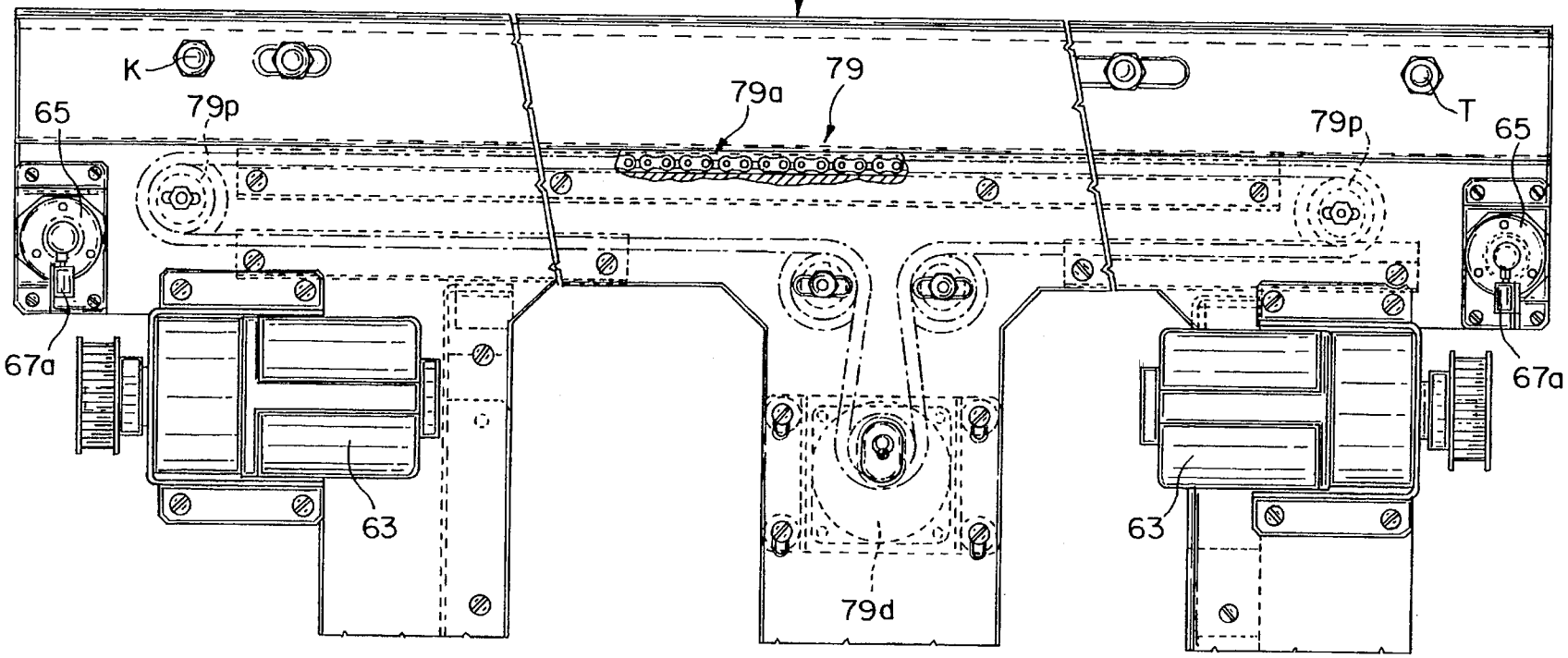
FIG. 4 shows a side view of the FIG. 3 detail.

More specifically, each locating assembly 64 comprises a linear actuator 65 fitted to an end portion (FIG. 4) of side 45, and presenting a shaft 66 extending towards rotary assembly 52*a*, 52*b*.

Each shaft 66 is connected to a microswitch 67*a* (FIG. 4) for starting/stopping motor 63.

Shaft 66 is movable between an idle position wherein a truncated-cone-shaped end portion 67 of shaft 66 engages a dead hole 61 in disk body 60, and an activating position wherein end portion 67 is detached from disk body 60.

In the idle position, microswitch 67*a* is set to a first state (e.g. is open) and motor 63 is idle; and in the activating position, microswitch 67*a* is set to a second state (e.g. is closed) and motor 63 is running.

To operate motor 63, actuator 65 is activated to withdraw end portion 67 from dead hole 61 and so set microswitch 67*a* to the second state to activate motor 63 and rotate assembly 52*a*, 52*b*.

As assembly 52*a*, 52*b* rotates, end portion 67 slides along the cylindrical lateral surface of disk body 60 until it engages another dead hole 61, which engagement axially shifts shaft 66 to open microswitch 67*a* and stop motor 63.

By virtue of locating assembly 64, rotary assembly 52*a*, 52*b* is thus rotated 90° by motor 63.

As shown particularly in FIG. 6, each push surface 42 is substantially rectangular, and comprises a flexible rectangular sheet 68 of flexible, transparent material (e.g. polycarbonate), and a connecting device 71 extending from a shorter edge of sheet 68 and connected to guide device 41.

Rectangular sheet 68 presents a substantially straight longer edge from which extends an integral trapezoidal appendix 68*a*, the function of which is described later on.

Connecting device 71 comprises a roughly rectangular metal plate 72 connected to sheet 68; and a prismatic body 73 extending from plate 72 and housable inside groove 48, 50 of guide 47, 49.

Sheet 68 comprises a rectangular end wing 68*b* (FIG. 6) presenting a circular upper through hole 69*c* engaged by a pin 56 for connection to plate 72, and an elongated lower hole 69*d* sloping a few degrees in relation to the longer edges of sheet 68, and which is engaged by a pin 57 fitted to plate 72 to permit sheet 68 to rotate a few degrees about pin 56 which is parallel to guides 47, 49.

As explained in more detail later on, each push surface 42 is movable towards front stop FR with prismatic body 73 sliding along guide 47, with the bottom edge of sheet 68 on surface 14, and with trapezoidal appendix 68*a* engaging toothed belt 38.

Each push surface 42 is also movable towards back stop BK with prismatic body 73 sliding along guide 49, and with sheet 68 positioned vertically and rotated 90° in relation to the forward-moving position.

Connecting device 71 presents a first connecting element 74 comprising a flat rectangular metal appendix extending from plate 72 and parallel to prismatic body 73.

Connecting device 71 also presents a second connecting element 77 comprising a metal appendix extending from plate 72 and substantially perpendicular to element 74.

As explained in more detail later on, first connecting element 74 engages a pin-chain 78 (FIGS. 6, 3, 5) presenting a straight upper portion 78*a* extending parallel to guide device 41, close to guide 47, and between two end pulleys 78*p*.

More specifically, pulleys 78*p* are fitted to a vertical side 78*b* in turn fitted to base 10 and parallel to side 45; and pin-chain 78 is moved from back stop BK to front stop FR by electric motor 39 (FIG. 5) fitted to base 10.

Via a transmission (not shown), electric motor 39 also drives toothed belt 38, so that toothed belt 38 and pin-chain 78 travel at the same speed in the same direction.

As described in more detail later on, second connecting element 77 engages a pin-chain 79 (FIGS. 6, 3, 4) presenting a straight upper portion 79*a* extending parallel to guide device 41 on the opposite side of guide 47 to portion 78*a*, and between two end pulleys 79*p* fitted to side 45; and pin-chain 79 is moved from front stop FR to back stop BK by an electric motor 79*d* (FIG. 4) fitted to side 45.

Device 1 also comprises a grip-and-carry assembly 70 located in front of straight edge 20 of surface 14, and which provides for gripping and removing items 7 off surface 14, and unloading them on to a conveyor belt device 75 (FIG. 2) housed in a rectangular channel 76 extending between assembly 70 and surface 14, and beneath end edge 20.

Figure 7:
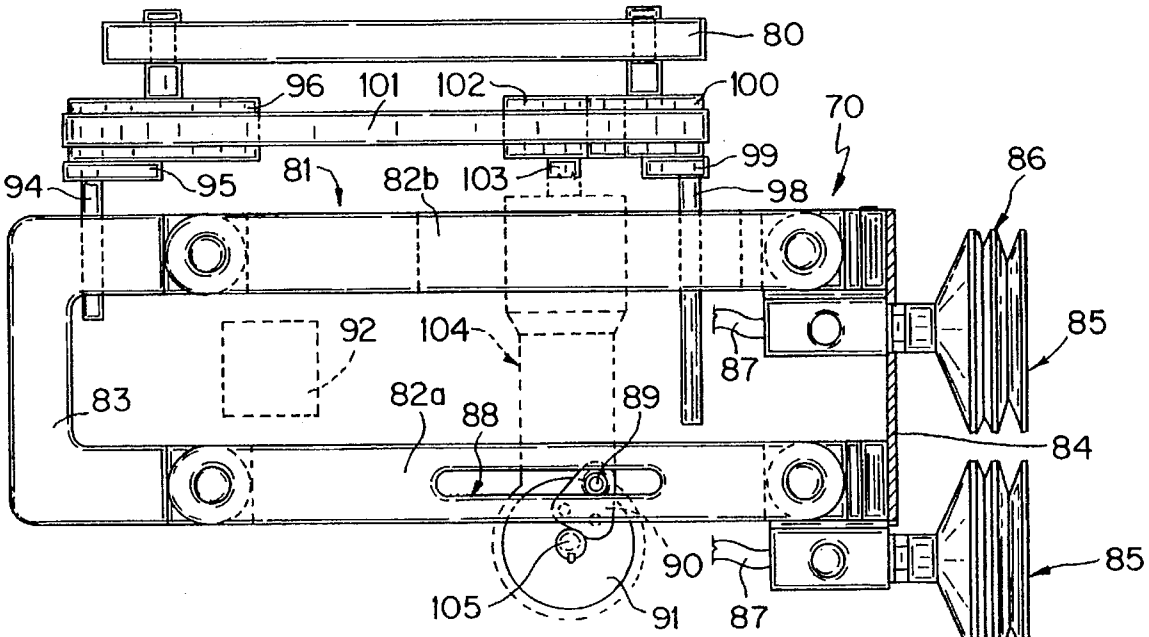
FIG. 7 shows a larger-scale top plan view of a second detail of the FIG. 1 device.
Figure 8:
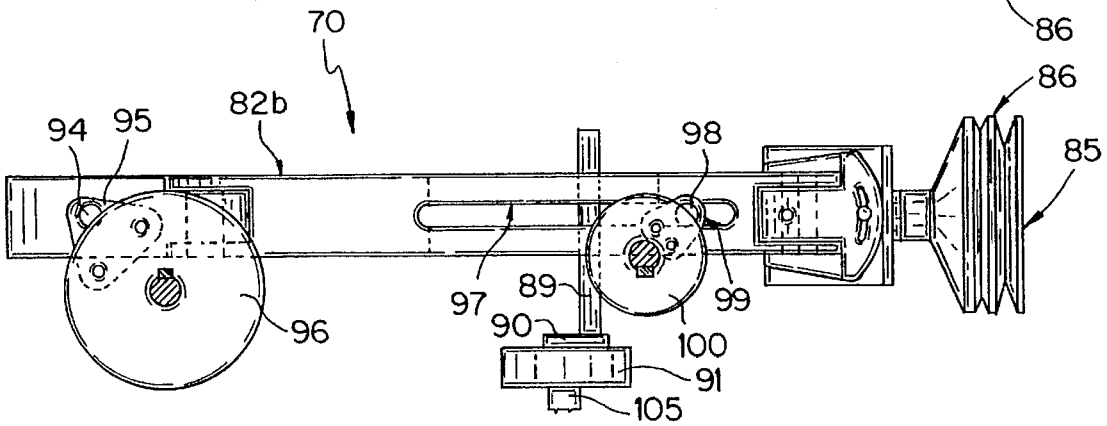
FIG. 8 shows a side view of the FIG. 7 detail.

As shown particularly in FIGS. 7 and 8, assembly 70 comprises a vertical supporting structure 80 (shown schematically) fitted at the bottom to base 10, and supporting, at the top, a parallelogram device 81 comprising two parallel arms 82*a*, 82*b*. Arms 82*a*, 82*b* present respective first ends hinged to a C-shaped element 83; and respective second ends hinged to the ends of a straight cross member 84 presenting two suction cups 85, each with an axially-deformable bellows type end portion 86, and each connected by a hose 87 (FIG. 7) to a vacuum-forming suction device (not shown).

A first arm 82*a* of device 81 presents a longitudinal slot 88 engaged by a pin 89 on the end of a triangular appendix 90 fitted to a pulley 91; and pulley 91 presents an axis inclined 10° to the horizontal, and is driven by an actuator 92 (FIG. 2), e.g. a low-inertia d.c. motor (shown schematically) connected to an angular position sensor (ENCODER) not shown.

Actuator 92 driving pulley 91 thus moves parallelogram device 81 in a plane inclined 10° to the horizontal. C-shaped element 83 is hinged to a pin 94 fitted to the end of a triangular appendix 95 extending radially from a vertical pulley 96 fitted to structure 80; and arm 82*b* presents a central elongated longitudinal slot 97 engaged in sliding manner by a pin 98 fitted to an appendix 99 extending radially from a pulley 100 fitted to structure 80.

Pulley 100 is smaller in diameter than pulley 96, and is connected by a belt 101 to pulley 96 and to a lower pulley 102 fitted to the horizontal output shaft 103 of an angular transmission 104 (shown by the dotted line) input connected to motor 92.

Transmission 104 also presents a vertical output shaft 105 fitted with pulley 91.

Each arm 82*a*, 82*b* of device 81 is thus movable reciprocatingly in crank and slotted link manner in a respective vertical plane and in a direction substantially perpendicular to edge 20 by actuator 92 driving pulleys 96, 100.

Consequently, by virtue of the crank and slotted link movement of arms 82*a*, 82*b* in parallel vertical planes, combined with the movement of parallelogram device 81 in a plane (not shown) inclined 10° to the horizontal, suction cups 85 are movable in space along a three-dimensional trajectory.

Conveyor belt device 75 is assisted by a number of auxiliary pinch roller devices 180 (shown schematically), each of which comprises a pair of parallel drive rollers 182*a*, 182*b* (FIG. 2) with their respective axes 183*a*, 183*b* positioned vertically, and the cylindrical outer surfaces of which are covered with elastic material. Each roller 182*a* is fitted to the end of an elastic supporting device (not shown) for pushing roller 182*a* towards roller 182*b* by means of an actuator (not shown), e.g. a pneumatic cylinder.

Pinch roller devices 180 are activated by respective sensors, e.g. photocells, 190 fitted to and spaced along channel 76, and each of which provides for detecting a mail item 7 in channel 76, and accordingly closing respective pinch roller device 180.

Device 1 also presents an optical sensor (not shown) comprising a photoemitter device (e.g. a LED) and a photodetecting device (e.g. a phototransistor) defining an optical path 200 (FIG. 2) through which extends a gripping plane (P) substantially perpendicular to surface 14.

Device 1 is connected to an electronic control unit 410 (FIG. 2) comprising a central microprocessor unit 411 and an electronic power circuit 412.

Unit 410 is supplied over respective lines (not shown) with the signals from the optical sensor, sensors 27*a*, 27*b*, and the encoder connected to motor 92.

Unit 410 is also connected over respective control lines (not shown) to actuator 39 of belt 38 and pin-chain 78, to actuators 36, 37 of belts 32, 32', and to electric motors 92, 63, 79*d* respectively driving grip-and-carry assembly 70, rotary assemblies 52*a*, 52*b*, and pin-chain 79.

Unit 410 controls the suction device (not shown) for activating and deactivating suction cups 85.

Unit 410 also cooperates with an optical sensor 250 (FIG. 2) conveniently comprising a photocell facing. edge 20, and a reflector (not shown) located close to edge 33; which sensor 250 defines an optical path H extending from grip-and-carry assembly 70 to rear edge 30, and perpendicular to edge 20.

Optical path H intersects all the transparent push surfaces 42 on surface 14.

Interruption of optical path H indicates that at least one mail item 7 is located on surface 14, in which case device 1 is started. Conversely, an uninterrupted optical path H indicates no mail items 7 on surface 14, in which case device 1 is stopped.

In actual use, mail items 7 are loaded by the operator between adjacent push surfaces 42, so that a small stack STK (maximum thickness roughly 70 millimeters) of mail items is formed in the space between each two adjacent sheets 68, and a number of stacks STK separated by push surfaces 42 are loaded on to surface 14.

Items 7 normally lie in nonparallel planes and form disorderly stacks; and the planes of items 7 are inclined in relation to the gripping plane P through optical path 200.

When optical path H is interrupted, device 1 is started to sort stacks STK; electronic unit 410 starts motor 39; and push surfaces 42 together with stacks STK of items 7 are moved towards straight front edge 20.

Each push surface 42 is moved along guide device 41 by pin-chain 78 engaging first connecting element 74 (FIG. 6), and by toothed belt 38 engaging appendix 68*a*, with prismatic bodies 73 sliding inside guide 47.

Items 7 continue moving along surface 14 until the bottom edge 17 of the first item 7 in the stack STK closest to end edge 20 contacts a portion of stop element 25 which activates microswitch 27*a* or 27*b*. At this point, electronic unit 410 accordingly activates belt pair 32 or 32' to move— e.g. by a predetermined amount—the item 7 closest to edge 20, in such a manner as to detach the portion of bottom edge 17 that activated microswitch 27*a*, 27*b*, and so rotate items 7 about their barycentric axis and reposition them in relation to gripping plane P; which positioning operations are repeated until item 7 is positioned with bottom edge 17 parallel to edge 20.

Electronic unit 410 then waits until the top edge of item 7 intercepts optical path 200 and simultaneously item 7 activates microswitches 27*a* and 27*b*, thus indicating that item 7 is positioned coplanar with gripping plane P; at which point, electronic unit 410 generates a withdrawal signal to commence removal of item 7 off surface 14.

Electronic unit 410 then starts motor 92 to grip the item 7 positioned in gripping plane P; and suction cups 85 move in space along a three-dimensional trajectory and laterally towards gripping plane P to engage and grip by suction the first item 7 in the stack. As of the above gripping position, suction cups 85 continue moving for a while in a direction substantially parallel to edge 20, and are then reversed and accelerated rapidly upwards to so stress item 7 as to separate it from stack STK. The rapid acceleration to which item 7 is subjected also provides for detaching it from a second item 7 clinging to it.

At this point, suction cups 85 move item 7 away from the stack, are accelerated towards conveyor belt device 75, and release item 7 when its lateral speed is parallel to the traveling direction of and close to the speed of conveyor device 75; the released item 7 travels along a parabolic trajectory, which terminates upon its straight edge 17 coming to rest on conveyor device 75; and conveyor device 75 carries item 7 away from grip-and-carry assembly 70 to enable the next withdrawal cycle.

The above operations are repeated for all the mail items in stack STK; and, during sorting, rotary assembly 52*a* presents a guide 54 aligned with guide 47.

When the items in stack STK have almost all been withdrawn, prismatic body 73 of the push surface 42 closest to edge 20 travels from guide 47 to a guide 54 aligned with guide 47, so that the push surface 42 closest to edge 20 moves from guide device 41 to rotary assembly 52*a*.

The engagement of prismatic body 73 inside guide 54 is detected by a known sensor K fitted to side 45 and facing rotary assembly 52*a*.

Sensor K supplies electronic unit 410 with a signal indicating engagement of push surface 42 with rotary assembly 52*a*; electronic unit 410 activates motor 63 to rotate assembly 52*a*; and assembly 52*a* rotates 90° to position guide 54 supporting prismatic body 73 in line with straight guide 49.

90° rotation of assembly 52*a* also rotates push surface 42 connected to it, which is detached from surface 14 and toothed belt 38 and positioned with its longitudinal axis upright.

The items in stack STK which have not yet been sorted thus come to rest on those in the adjacent stack STK.

As the front push surface 42 is being rotated, those on surface 14 continue traveling along guide device 41.

When fully rotated, push surface 42 is thus positioned substantially vertically, and second connecting element 73 engages pin-chain 79 which feeds push surface 42 towards back stop BK.

The movement of push surface 42 commences along guide 54 and continues along guide 49 of guide device 41.

At the end of guide device 41, push surface 42 reaches rotary assembly 52*b* where the above operations are repeated.

More specifically, push surface 42 continues moving until prismatic body 73 travels from guide 49 to a guide 54 of rotary assembly 52*b*, so that push surface 42 moves from guide device 41 to rotary assembly 52*b*.

The engagement of prismatic body 73 inside guide 54 is detected by a known sensor T fitted to side 45 and facing rotary assembly 52*b*, and which supplies electronic unit 410 with a signal indicating engagement of push surface 42 with rotary assembly 52*b*.

Generation of the engagement signal, however, is not followed immediately by rotation of assembly 52*b*, as electronic unit 410 waits for the push surface on surface 14 and closest to edge 33 to move a given distance away from edge 33.

Electronic unit 410 then starts motor 63 to rotate assembly 52*b* by 90° and position guide 54 supporting prismatic body 73 in line with straight guide 47.

90° rotation of assembly 52*b* also rotates the push surface 42 connected to it, which is positioned on surface 14 at a given distance D from the push surface closest to edge 33, and with its longitudinal axis positioned horizontally, and portion 68*a* engaging toothed belt 38.

Stop element 25 also provides for detecting the absence of items 7 in the space between grip-and-carry assembly 70 and the push surface 42 closest to edge 20. The absence of items 7 may be determined, for example, by non-activation of stop element 25 for a given time T, in which case, a no-stack signal is generated, and electronic unit 410 increases the speed of push surfaces 42 along surface 14 until the first item 7 contacts element 25.

Push surfaces 42 generally travel at a slower speed along guide 47 towards front stop FR than along guide 49 towards back stop BK.

The device according to the present invention thus provides for withdrawing mail items 7 from a number of substantially disorderly stacks STK.

Device 1 also provides for processing a number of small stacks of mail items, for simplifying manual loading of device 1, as well as positioning of the mail item for withdrawal, by virtue of belts 32, 32' moving an item forming part of a small stack STK. The reduced thickness of the stacks (maximum 70 millimeters), and the non-compacted arrangement of the mail items in them, provide for reducing adhesion of the mail items, and so preventing withdrawal of more than one item clinging to each other (multiple withdrawal).

Being made of light, flexible material, push surfaces 42 provide for troublefree loading of the stacks on to device 1.

Moreover, being made of transparent material, push surfaces 42 enable full visibility of the items in each stack STK.

The sorting device according to the invention provides for processing a large number of items 7, roughly 5000–7000 an hour.

Clearly, changes may be made to the sorting device as described and illustrated herein without, however, departing from the scope of the present invention.

We claim:

1. A mail sorting device comprising:

a supporting surface for supporting a number of flat mail items, said supporting surface presenting an end edge connected to stop means;

a grip-and-carry device facing said end edge and presenting at least one gripping head movable to and from said supporting surface, said gripping head withdrawing a mail item from said supporting surface, and feeding it to a conveyor device; and conveyor means for feeding said mail items towards said stop means;

characterized in that said conveyor means comprise a number of push surfaces spaced along said supporting surface and moved towards said stop means by drive means;

first guide and conveying means for moving said push surfaces towards a front stop;

second guide and conveying means for moving said push surfaces towards a back stop first switching means located at said front stop and which provide for successively transferring said push surfaces from said first guide and conveying means to said second guide and conveying means; and second switching means located at said back stop and which provide for successively transferring said push surfaces from said second guide and conveying means to said first guide and conveying means;

said mail items being grouped into stacks interposed between adjacent said push surfaces.

2. A device as claimed in claim 1, characterized in that said first guide and conveying means comprise a first straight guide extending along one side of said supporting surface; and a first linear conveying device engaging a first end portion of said push surface to move said push surface along said first guide;

said second guide and conveying means comprising a second straight guide parallel to said first guide; and a second linear conveying device engaging a second end portion of said push surface to move said push surface along said second guide;

each said push surface presenting a slide portion sliding along said first straight guide and along said second straight guide.

3. A device as claimed in claim 3, characterized in that said first straight guide and said second straight guide are fitted to a straight elongated support;

said first straight guide and said second straight guide being located on respective surfaces perpendicular to each other.

4. A device as claimed in claim 3, characterized in that said first switching means and said second switching means comprise first and second rotary assemblies extending axially from the front and rear ends of said straight elongated support;

said first and second rotary assemblies being movable angularly in relation to the axis of said straight elongated support by first and second actuating means;

said first and second rotary assemblies comprising at least one straight guide portion;

said first and second rotary assemblies being movable between at least a first angular position wherein said straight guide portion is aligned with and communicates with said first straight guide, and a second angular position wherein said straight guide portion is aligned with and communicates with said second straight guide.

5. A device as claimed in claim 4, characterized in that said first and second rotary assemblies comprise four straight guide portions parallel to one another and located on perpendicular faces of an elongated, square-section body coaxial with said axis.

6. A device as claimed in claim 4, characterized in that said first and second actuating means provide for effecting 90° angular rotations of said rotary assemblies.

7. A device as claimed in claim 4, further comprising synchronizing means for aligning said guide portion with said first straight guide or with said second straight guide.

8. A device as claimed in claim 7, characterized in that said synchronizing means comprise:

a disk body integral with said rotary assembly and presenting dead holes angularly spaced at 90° to one another in relation to said axis of said elongated support;

a locating body movable by third actuating means to and from said disk body and between an idle position wherein said locating body engages a said hole, and an activating position wherein said locating body is withdrawn from said hole; and switch means connected to said third actuating means, and presenting a first state in said idle position and a second state in said activating position;

said switch means cooperating with said first and second actuating means;

said first and second actuating means being activated when said switch means are in said second state, and being arrested when said switch means are in said first state.

9. A device as claimed in claim 1, characterized in that each said push surface comprises a sheet connected to a slide portion traveling along said first and said second guide and conveying means;

said sheet being hinged at one end to said slide portion, and being movable angularly about an axis parallel to said first and second guide and conveying means.

10. A device as claimed in claim 1, characterized in that each said push surface comprises a sheet of flexible material.

11. A device as claimed in claim 1, characterized in that each said push surface comprises a sheet substantially perpendicular to said supporting surface.

12. A device as claimed in claim 1, characterized in that said conveyor means comprise a toothed belt along said supporting surface and movable towards said end edge by said drive means;

each push surface comprising a substantially rectangular sheet presenting a straight edge from which extends an integral appendix for engaging said toothed belt.

13. A device as claimed in claim 1, characterized in that each said push surface comprises a sheet of transparent material.

14. A device as claimed in claim 13, further comprising sensor means defining an optical path which extends from said grip-and-carry device towards said push surfaces, and which intercepts the push surfaces;

said sorting device comprising electronic means for determining non-interruption of said optical path when no mail item is present on said supporting surface, and for generating a stop signal.

15. A device as claimed in claim 1, further comprising electronic means cooperating with said stop means, and for determining non-activation of said stop means due to the absence of mail items in the space between said grip-and-carry device and the push surface closest to said end edge;

said electronic means generating a no-stack signal for modifying, in particular increasing, the traveling speed of said push surfaces towards said stop means.

16. A mail sorting device comprising:

a supporting surface for supporting a number of flat mail items, said supporting surface presenting an end edge connected to stop means;

a grip-and-carry device facing said end edge and presenting at least one gripping head movable to and from said supporting surface, said gripping head withdrawing a mail item from said supporting surface, and feeding it to a conveyor device; and conveyor means for feeding said mail items towards said stop means;

said conveyor means comprising a number of push surfaces spaced along said supporting surface and moved towards said stop means by drive means, each said push surface comprising a sheet of transparent material;

said mail items being grouped into stacks interposed between adjacent said push surfaces, and further comprising sensor means defining an optical path which extends from said grip-and-carry device towards said push surfaces, and which intercepts the push surfaces;

said sorting device comprising electronic means for determining non-interruption of said optical path when no mail item is present on said supporting surface, and for generating a stop signal.

* * * * *